United States Patent [19]

Opp

[11] 4,278,116

[45] Jul. 14, 1981

[54] PORTABLE LATCH FOR GASOLINE NOZZLES

[76] Inventor: Gerald R. Opp, 1231 Hewitt Ave., St. Paul, Minn. 55104

[21] Appl. No.: 77,318

[22] Filed: Sep. 20, 1979

[51] Int. Cl.[3] ..... B65B 3/04; B67C 3/00

[52] U.S. Cl. ..... 141/392; 74/526; 251/90

[58] Field of Search ..... 403/33, 405, 409, 410; 141/392; 74/526; 251/90, 111

[56] References Cited

U.S. PATENT DOCUMENTS 4,201,253 5/1980 Maloney ..... 141/392

*Primary Examiner*—Houston S. Bell, Jr.

[57] ABSTRACT

A latching device for insertion into a gas dispensing nozzle between the dispensing handle and the handle guard member, the latch having shoulders for seating between these members and for holding the dispensing handle in one of at least two fixed positions, the latch device further having at least two sets of such shoulders for utilization with gasoline dispensing nozzles of at least two different styles and sizes, the latching device being portable and removable from the gasoline dispensing nozzle.

3 Claims, 3 Drawing Figures

PORTABLE LATCH FOR GASOLINE NOZZLES

BACKGROUND OF THE INVENTION

This invention relates to a latching device for insertion into a gasoline dispensing nozzle and for holding the dispensing handle in at least two predetermined flow rate positions; the invention particularly relates to a latching device which is portable and removable from the gasoline dispensing nozzle and which may be carried about and reused with different styles and sizes of gasoline dispensing nozzles.

Gasoline dispensing nozzles of the type found in commercial retail gas stations are typically of two sizes and styles. The first type is described in U.S. Pat. No. 3,085,600, issued Apr. 16, 1963, wherein a gasoline dispensing handle having a high degree of curvature is positionable within a frame member to regulate the delivery rate of gasoline. Such gasoline nozzles when utilized by commercial gasoline service stations wherein an employee of the service station delivers the gasoline have incorporated therein a latching member as a part of the nozzle assembly which permits the attendant to latch the delivery handle into one of typically three positions for slow, medium, and fast gasoline delivery. This enables the attendant to fill the gasoline tank of the customer while he is attending to other needs and services for the customer.

A second type of gasoline dispensing nozzle is illustrated in U.S. Pat. No. 3,653,415, issued Apr. 4, 1972. This dispensing nozzle is of a different size configuration than the aforementioned nozzle, but operates generally according to the same technique. This dispensing nozzles utilizes a delivery handle of different configuration and, when used by commercial service stations wherein gas is delivered by a service station attendant, utilizes a latching mechanism attached to the delivery handle, which mechanism latches against a lever having one or more detents built into the handle guard assembly.

Both of the aforementioned gasoline dispensing nozzles have a built-in pressure sensor which automatically disconnects the delivery handle from the internal nozzle valving mechanism whenever the customer's gasoline tank approaches a filled condition. When this occurs, the handle delivery member is effectively disabled from operating the internal flow valve mechanism, which prevents a service station attendant from inadvertently permitting gasoline to overfill the tank and run out onto the ground.

Both of the aformentioned gasoline dispensing nozzles are typically used in commercial service stations throughout the United States and other countries. However, with the increasing popularity of self-service gasoline stations it has frequently become the practice for service station owners to disable and disconnect the built-in latching mechanism. Apparently this has been thought to be necessary in order to prevent the customer from utilizing the built-in latching mechanism, either because it is believed that the customer would be unfamiliar with the proper operation of this mechanism, or because the customer may not be knowledgeable as to how to disconnect the latching mechanism under conditions where the customer desires less than a full tank of gasoline. Therefore, in self-service gasoline service stations it is typically necessary for the customer to continually stand and squeeze the gasoline delivery handle for so long as he wishes gasoline to be delivered into his tank, preventing him from attending any other service needs of his vehicle. In cold weather climates this is particularly burdensome, for not only is it undesirable to stand outside in cold weather while waiting for the gasoline tank to become filled, but also the temperature of the gasoline dispensing nozzle becomes extremely cold by virture of the gasoline flow through it. Accordingly, it would be useful if the customer were provided with a portable latching mechanism which would enable the customer to set the gasoline flow rate and leave the nozzle unattended while gasoline is being delivered to the tank. The automatic pressure sensing feature in such gasoline dispensing nozzles will prevent any overfillings from occurring and will disable the gasoline delivery handle from the nozzle flow control valve whenever the tank approaches a filled condition.

SUMMARY OF THE INVENTION

The present invention comprises a portable latching device which may be conveniently carried by the operator of a motor vehicle, and may be inserted into either of the aforementioned gasoline dispensing nozzle types, and which provides a predetermined gasoline flow rate control in at least two positions of the gasoline delivery handle, and which may be easily removed from the gasoline dispensing nozzle when the delivery is completed.

BRIEF DESCRIPTION OF THE DRAWINGS

A preferred embodiment of the invention is described hereinafter, and with reference to the appended drawings, in which.

DETAILED DESCRIPTION OF THE INVENTION

Figure 1:
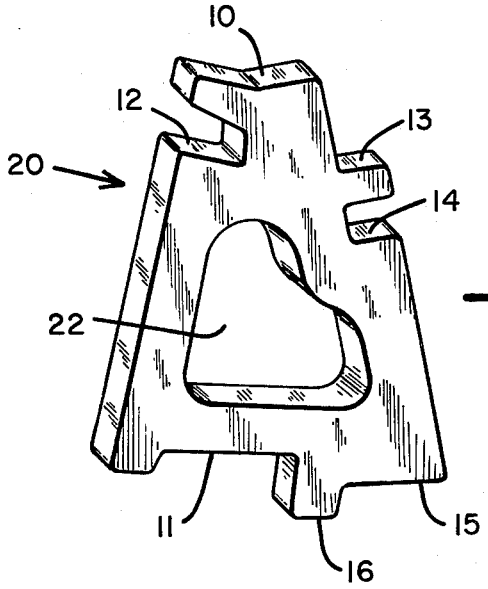
FIG. 1 illustrates an isometric view of the invention.
Figure 2:
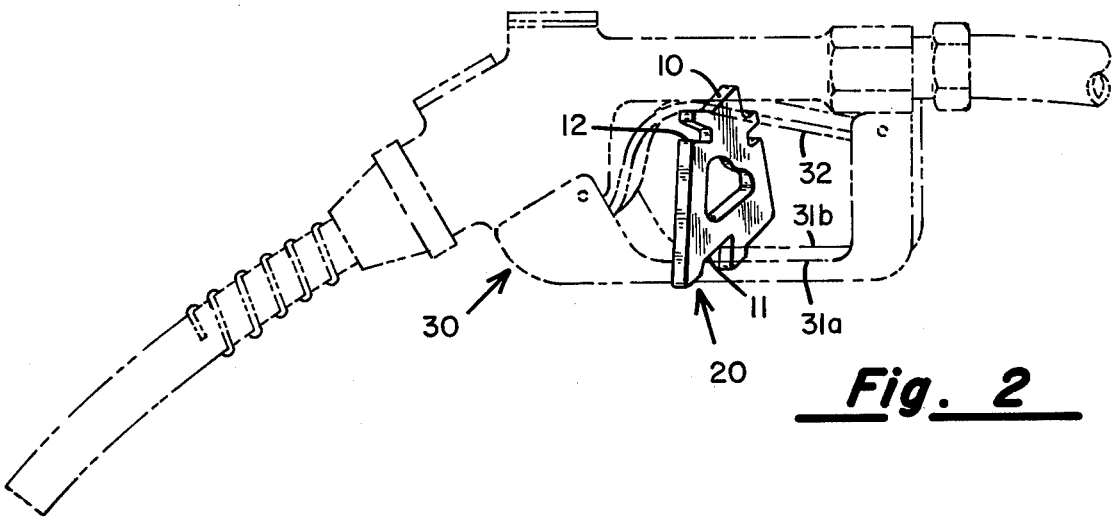
FIG. 2 shows the invention in an operable position on a gasoline dispensing nozzle.

Referring first to FIG. 1 there is shown an isometric view of the invention. The invention is made from plastic, metal, or other reasonably rigid material having a relatively narrow thickness. For example, the invention may be stamped or molded from plastic having a thickness of $\frac{1}{8}$ inch–$\frac{1}{2}$ inch, more or less, and be fit for the purpose intended. A top shoulder 10 is shaped to generally conform with the cross-sectional curvature of a gasoline delivery handle so as to be seated against it. A bottom recess 11 is sized so as to permit the gasoline handle guard to fit therein. Therefore, latching device 20 may be inserted between the gasoline delivery handle, seated on shoulder 10, and the handle guard, seated within recess 11, and thereby to hold the delivery handle at a predetermined position for delivery of gasoline at a corresponding flow rate. A second shoulder 12 is provided for optional seating of the gasoline delivery handle at a predetermined position closer to the handle guard than is provided by shoulder 10. If the gasoline delivery handle is placed on shoulder 12 the distance between the handle and the handle guard is reduced, thereby providing a slower flow rate through the nozzle. Reference should be made to FIG. 2, wherein the latching device 20 is shown inserted into a gasoline dispensing nozzle 30, holding delivery handle 32 a predetermined distance from handle guard 31. It should be noted that handle guard 31 may be formed from two parallel sections 31A and 31B, and in this regard latching device 20 may be fitted bridging either one or both of the sections. Although the illustration of FIG. 2 shows lever 32 to be supported on shoulder 10, the latching device may be positioned so as to support handle 32 on shoulder 12 in order to obtain a second flow rate delivery position.

Figure 3:
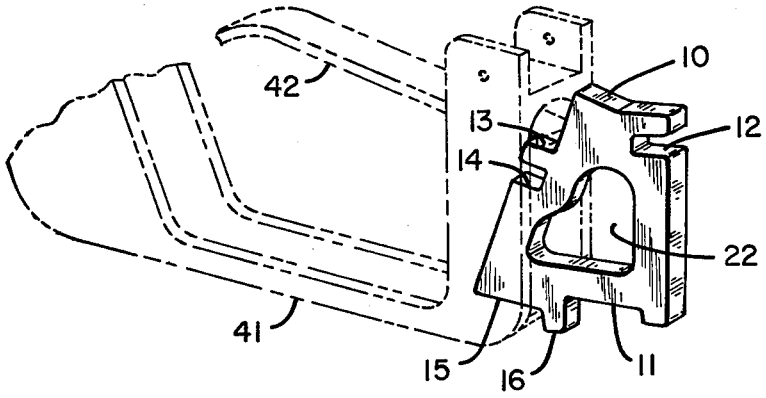
FIG. 3 shows the invention in a second operable position on a gasoline dispensing nozzle.

The latching device may also be utilized with certain gasoline dispensing nozzles by inserting the latching device into the rear opening of the dispensing nozzle as shown in FIG. 3. A shoulder 13 may be inserted under dispensing handle 42 and a bottom surface 15 inserted against guard 41 so as to hold handle 42 at a predetermined spaced position and thereby to provide a predetermined flow rate through the nozzle. Alternatively, the latching device may be inserted so as to place handle 42 against shoulder 14, which will cause a predetermined lower flow rate of gasoline through the nozzle. A lower shoulder 16 projects from surface 15 so as to limit the insertion distance of latching device 20 into the nozzle opening. After the latching device has been used it may be easily removed by grasping it through hold 22 and pulling it from the gasoline dispensing nozzle.

In operation with gasoline dispensing nozzles of either the type shown in FIG. 2 or the type shown in FIG. 3, the user first determines which of the shoulder combinations of the latching device are best suited for the particular dispensing nozzle he is using. He then inserts it into the nozzle dispensing opening as shown and selects a predetermined desired flow rate. Once the device is inserted in the dispensing nozzle the selected flow rate will deliver gasoline until either the device itself is removed or the internal dispensing nozzle valve senses that the gasoline tank is filled and automatically shuts off the delivery valve. The latching device may then be removed and held by the vehicle owner until it is needed again.

Of course, other and further shoulders could be provided in the latching device for enabling the selection of differing gasoline flow rates. I have determined that the present invention as disclosed provides the preferable flow rates and is usable with all known gasoline dispensing nozzles in one of the two forms disclosed herein. It is therefore believed that the provision for additional flow rate regulation is unnecessary in practical application. Some vehicles have constrained filler pipes between the gasoline tank and the nozzle insertion point, and for these vehicles I have found the lower flow rate regulation is preferable. Other vehicles will accept the gasoline flow rate near the maximum capacity of the dispensing nozzle and should 13 and top surface 10 have been selected to provide approximately this maximum capacity flow rate.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A portable gasoline dispensing nozzle trigger latching device adapted for controlling gasoline flow delivery rate in one or more predetermined positions, comprising a member having a recessed portion along a bottom edge for seating against a gasoline dispensing nozzle frame and having a top edge shaped for seating against a gasoline dispensing nozzle trigger to hold said trigger in a first predetermined position, said member having a first side edge notched a predetermined distance away from said top edge, said side notch sized to accept said gasoline dispensing nozzle trigger and to hold said trigger in a second predetermined position.

2. The apparatus of claim 1, further comprising a second side edge having a first shoulder for seating against said trigger and for holding said trigger in a third predetermined position, and said second side edge further having a second shoulder for seating against said trigger and for holding said trigger in a fourth predetermined position.

3. The apparatus of claim 2, further comprising an opening approximately centrally positioned in said member, said opening having a size sufficient to insert a human finger therethrough.

* * * * *